US009103610B2

(12) United States Patent
Wilcox et al.

(10) Patent No.: US 9,103,610 B2
(45) Date of Patent: Aug. 11, 2015

(54) TOOL-LESS VARIABLE GAS BLOCK

(71) Applicants: Dave Wilcox, Molalla, OR (US); Matthew Davis, Canby, OR (US)

(72) Inventors: Dave Wilcox, Molalla, OR (US); Matthew Davis, Canby, OR (US)

(73) Assignee: CHAZKAT, LLC, Canby, OR (US)

( * ) Notice: Subject to any disclaimer, the term of this patent is extended or adjusted under 35 U.S.C. 154(b) by 88 days.

(21) Appl. No.: 13/666,192

(22) Filed: Nov. 1, 2012

(65) Prior Publication Data

US 2014/0090550 A1 Apr. 3, 2014

Related U.S. Application Data

(60) Provisional application No. 61/554,420, filed on Nov. 1, 2011.

(51) Int. Cl.
*F41A 5/28* (2006.01)
*F41A 5/18* (2006.01)

(52) U.S. Cl.
CPC .... *F41A 5/18* (2013.01); *F41A 5/28* (2013.01)

(58) Field of Classification Search
CPC ..... F41A 5/28; F41A 5/26; F41A 5/18
USPC ..... 89/191.01, 191.02, 192, 193
See application file for complete search history.

(56) References Cited

U.S. PATENT DOCUMENTS

| | | | | |
|---|---|---|---|---|
| 2,003,066 | A * | 5/1935 | Brondby | 89/193 |
| 2,340,293 | A * | 2/1944 | Balleisen | 138/45 |
| 2,462,119 | A * | 2/1949 | Moore | 89/193 |
| 2,845,008 | A * | 7/1958 | Atwood, Jr. | 89/193 |
| 4,126,077 | A * | 11/1978 | Quesnel | 89/1.704 |
| 4,244,273 | A * | 1/1981 | Langendorfer et al. | 89/193 |
| 4,977,815 | A * | 12/1990 | Stephens | 89/180 |
| 5,272,956 | A * | 12/1993 | Hudson | 89/128 |
| 5,768,818 | A * | 6/1998 | Rustick | 42/75.02 |
| 5,945,626 | A | 8/1999 | Robbins | |
| D627,849 | S | 11/2010 | Keller | |
| 7,827,722 | B1 * | 11/2010 | Davies | 42/75.02 |
| 7,832,326 | B1 * | 11/2010 | Barrett | 89/191.01 |
| 7,856,917 | B2 * | 12/2010 | Noveske | 89/193 |
| 7,891,284 | B1 * | 2/2011 | Barrett | 89/193 |
| 7,921,760 | B2 | 4/2011 | Tankersley | |
| 7,934,447 | B2 * | 5/2011 | Kuczynko et al. | 89/193 |
| 8,109,196 | B1 * | 2/2012 | Spence | 89/193 |
| 8,161,864 | B1 * | 4/2012 | Vuksanovich | 89/191.01 |
| 8,261,653 | B2 * | 9/2012 | Crommett | 89/193 |
| 8,307,750 | B2 * | 11/2012 | Vuksanovich et al. | 89/191.01 |
| 8,528,458 | B2 * | 9/2013 | Windauer | 89/193 |
| 8,584,575 | B2 * | 11/2013 | Crommett | 89/193 |
| 8,607,688 | B2 * | 12/2013 | Cassels | 89/193 |
| 2010/0269682 | A1 * | 10/2010 | Vuksanovich et al. | 89/191.01 |
| 2010/0275770 | A1 * | 11/2010 | Noveske | 89/193 |

OTHER PUBLICATIONS

AR-15 exploded view, from http://weaponsman.com/?p=2959, publication date unknown.

* cited by examiner

*Primary Examiner* — Jonathan C Weber
(74) *Attorney, Agent, or Firm* — patenttm.us

(57) ABSTRACT

An adjustable gas block is provided enabling variable adjustment of the amount of gas return. The adjustment knob is provided at a non-perpendicular/non-parallel angle to the firearm barrel enabling manual adjustment and without requiring tools to perform the adjustment, thereby providing a gas block that can variably adjust the amount of gas entering the gas tube.

11 Claims, 10 Drawing Sheets

TOOL-LESS VARIABLE GAS BLOCK

CROSS-REFERENCE TO RELATED APPLICATIONS

This application claims priority of U.S. provisional patent application Ser. No. 61/554,420, filed Nov. 1, 2011.

BACKGROUND OF THE INVENTION

This disclosure relates to firearms, and more particularly to a gas block with variable adjustment features, for a gas operated firearm.

A gas block is a component for a gas operated firearm, for example, the AR-15/M16 shooting platform, that directs gas from the barrel into a gas tube which carries the gas to a receiver to cycle the action of the firearm.

Adjustment of the amount of return gas can be desirable, and on/off return valves have been provided and, as shown in US published patent application 20100275770, an adjustable gas block providing off, medium or full return levels has been considered. However, as users employ different types of ammunition with resulting different amounts of return gas, and for different types of use, superior adjustment capabilities are desirable, but not provided by the on/off or off/medium/high level settings of the prior art.

SUMMARY OF THE INVENTION

In accordance with the disclosure herein, a variable adjustable gas block is provided enabling variable adjustment of the amount of gas return, without requiring tools to perform the adjustment.

Accordingly, it is an object of the present disclosure to provide an improved gas block that enables user adjustment of the amount of return gas.

It is a further object of the present disclosure to provide an improved adjustment feature to a gas block, whereby adjustment is accomplished without use of additional tools.

It is yet another object of the present disclosure to provide an improved gas block with a number of adjustment levels of the amount of gas return.

The subject matter of the present gas block is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present gas block comprises a gas block by which the user can variably adjust the amount of gas entering the gas tube of the firearm. This allows a shooter to adjust the pressure used to cycle the firearm which can reduce the felt recoil and cause the gun to cycle faster or slower. Blocking off of gas transfer from the firearm barrel to the firearm gas tube is accomplished using a rod threaded on one portion. As the rod is screwed in it blocks gas transfer which in turn limits or increases the amount of gas allowed through and therefore varies the pressure in the tube. With this tool-less design a spring loaded knob attached to the threaded rod is employed to allow the shooter to pull out the knob disengaging it from the locking mechanism so the knob can be turned, consequently threading the rod in or out blocking of more or less of the gas transfer. The shooter then releases the knob allowing it to return by operation of the spring back into the locked position where once again it cannot turn.

Figure 1:
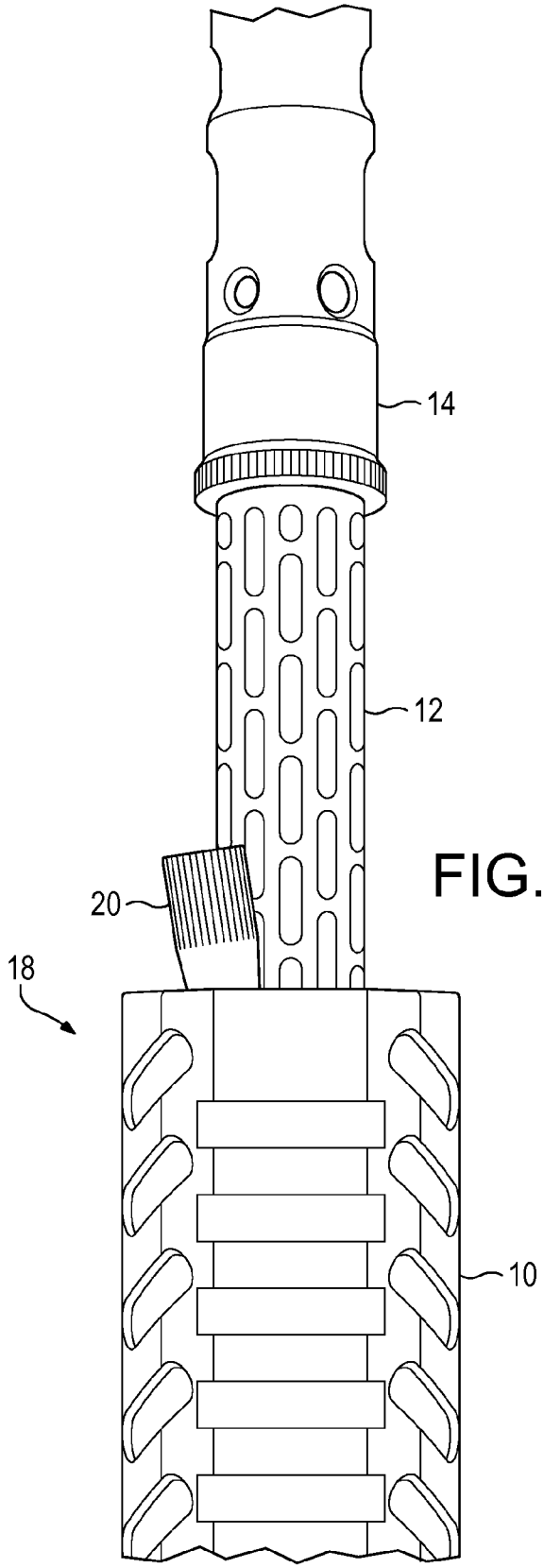
FIG. 1 is a top photographic view of a firearm with a variable gas block mounted thereon.
Figure 2:
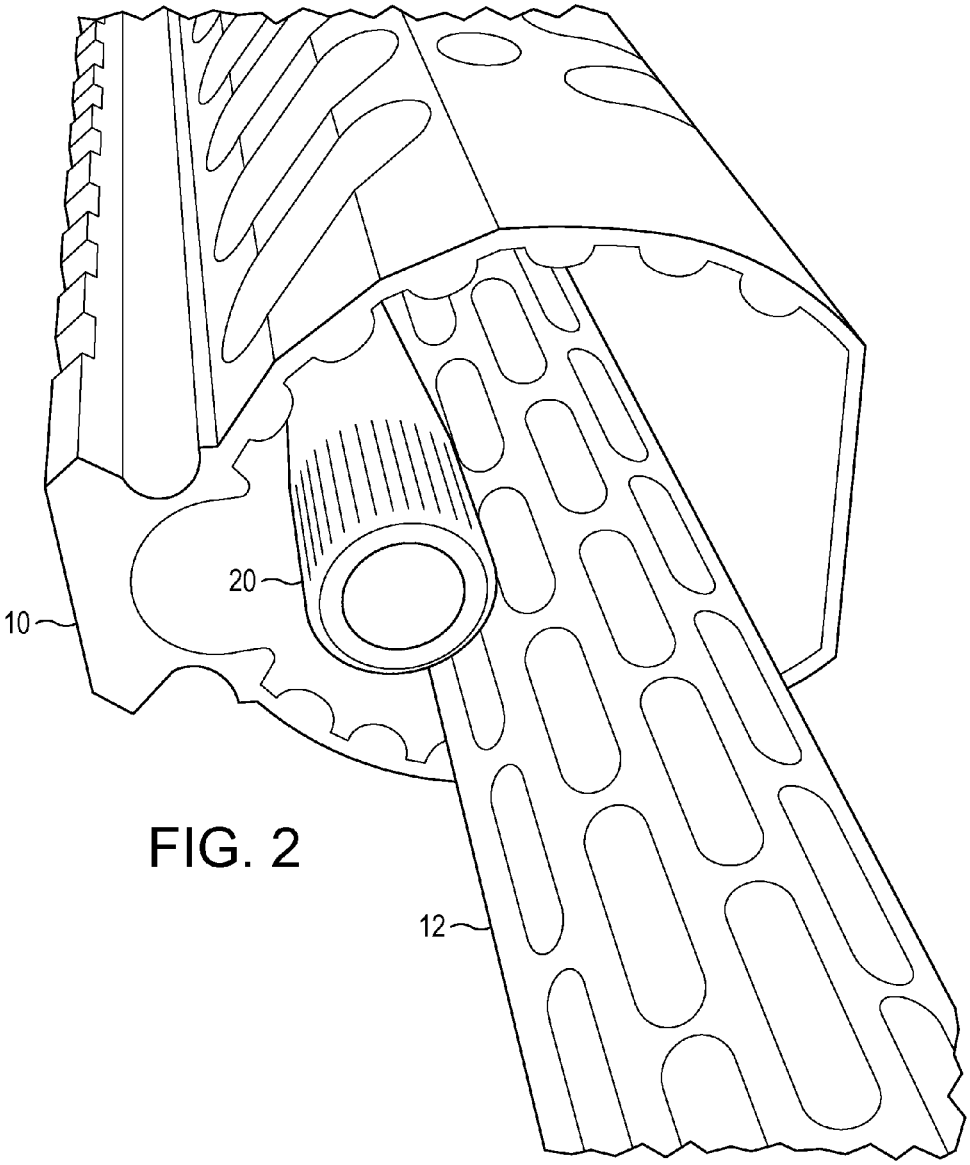
FIG. 2 is a close up photograph of the variable gas block of FIG. 1.

Referring now to FIG. 1, a top photographic view of a firearm with a variable gas block mounted thereon, and FIG. 2, a close up photograph of the variable gas block when mounted, showing the adjustment knob, the firearm comprises a hand guard 10 surrounding a barrel 12 extending from the hand guard, an a muzzle brake 14 mounted at the end of the barrel. Within the hand guard, not visible, is gas tube 16 which carries the gas back to the receiver.

A variable gas block 18 is mounted around the barrel, within the hand guard, so as to effect the redirection of the gas to the gas tube. When mounted to the firearm, gas block adjustment knob 20 extends outwardly from the forward opening of the hand guard, to be accessible by a user's hand for adjustment thereof, as discussed herein.

Figure 3:
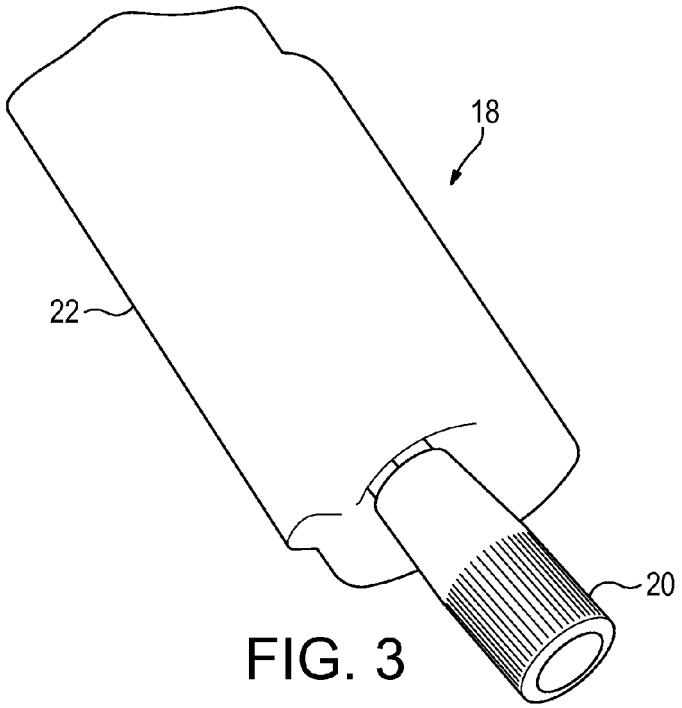
FIG. 3 is a perspective photograph of the variable gas block, separate from the firearm.
Figure 4:
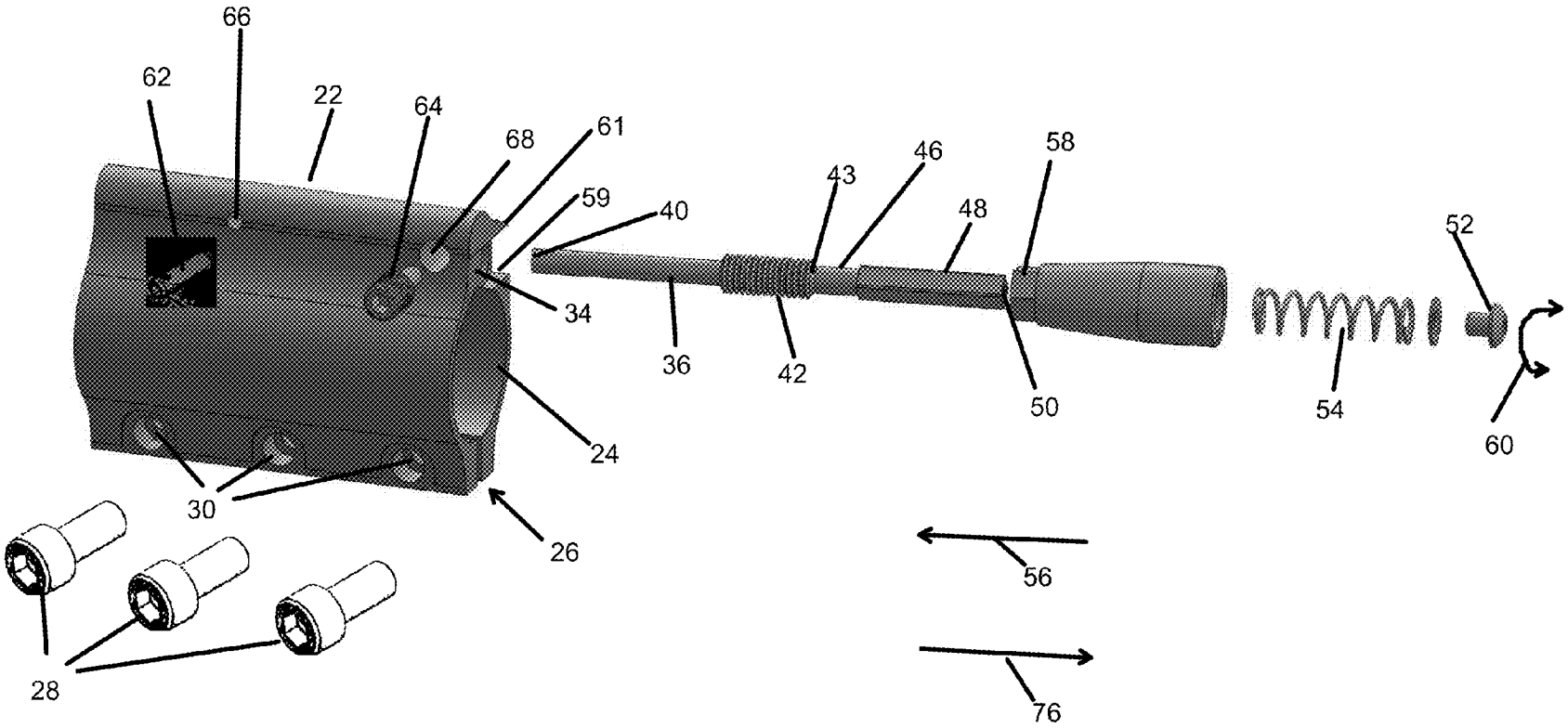
FIG. 4 is an exploded perspective view of the variable gas block.
Figure 5:
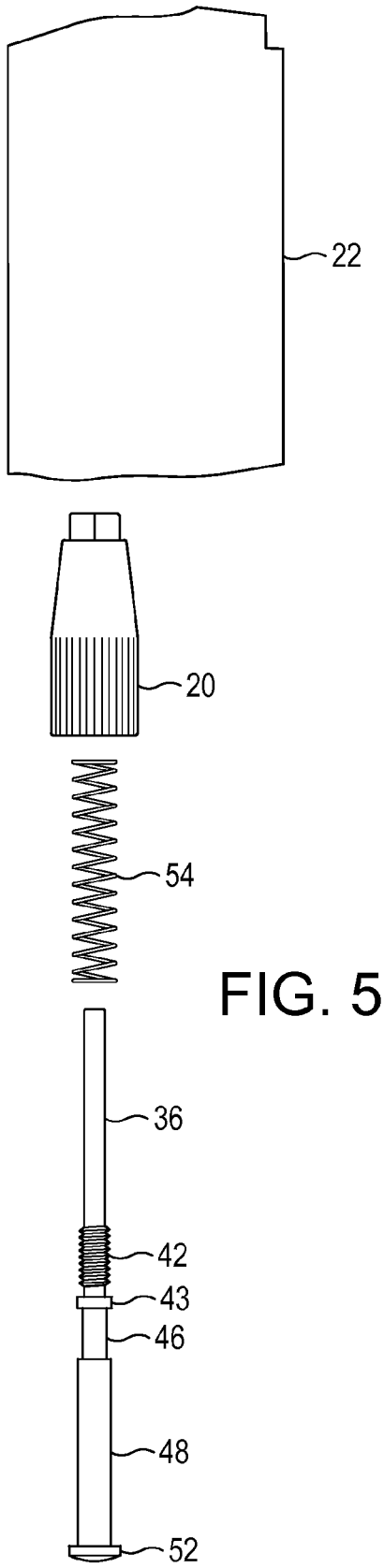
FIG. 5 is an exploded photograph of the device.
Figure 6:
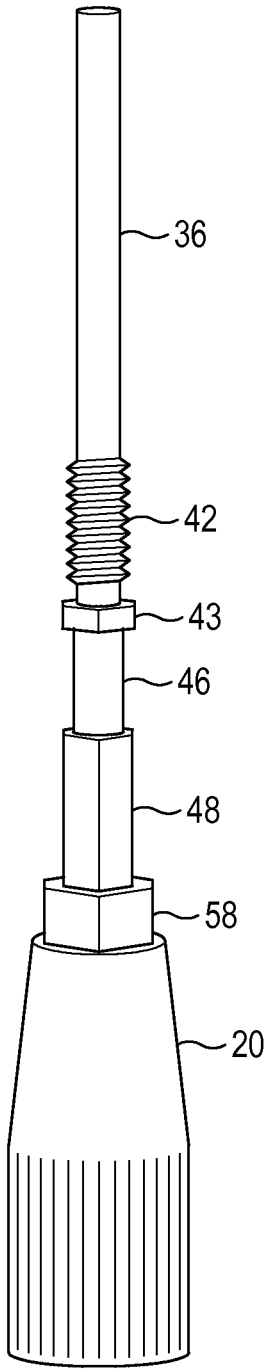
FIG. 6 is a view showing engagement of the adjustment knob and adjustment rod.
Figure 8:
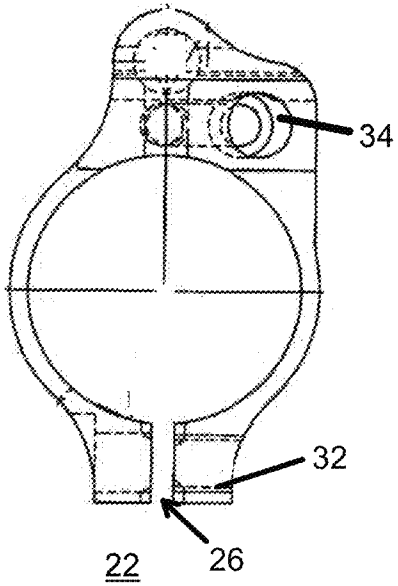
Figure 10:
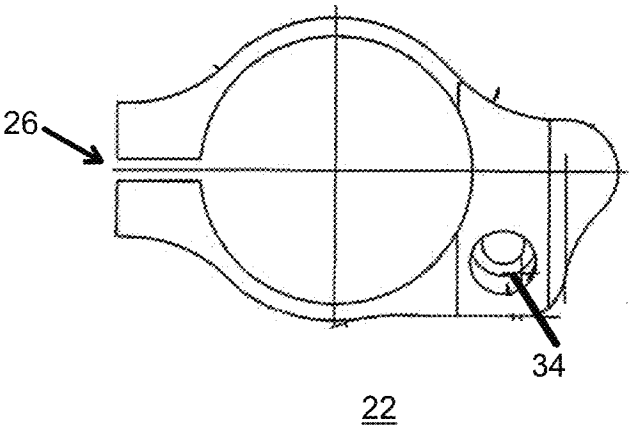
Figure 9:
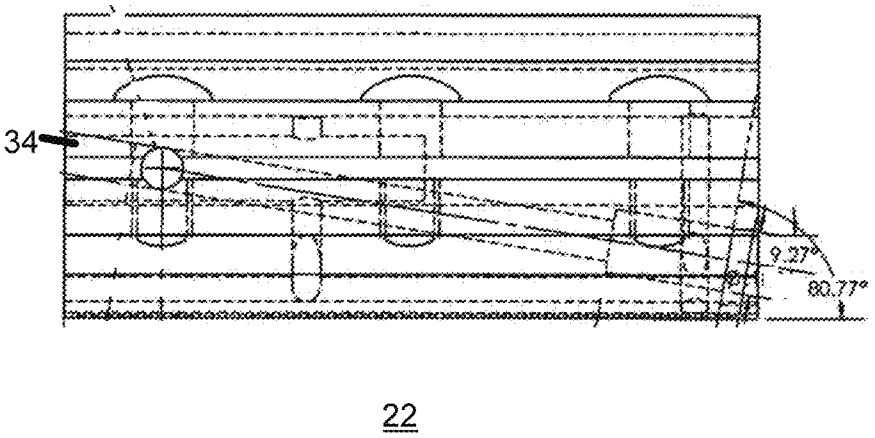

FIG. 3 is a perspective photograph of the variable gas block 18 in assembled form, while FIG. 4 is an exploded perspective view of the variable gas block, when separate from the firearm. A mounting body 22 is provided as a clam-shell configuration with a central tubular opening 24 that is defined when the mounting body is assembled, to receive the barrel therethrough, enabling the mounting body to be moved along the barrel into a desired mounting position. The body has a split configuration with a longitudinal bottom split 26 for ease of mounting to the barrel, bolts 28 being employed to secure the body in position on the barrel by clamping action as a result of the split 26 and threaded engagement of the bolts through the bolt holes 30 and corresponding threaded openings 32 (visible in FIG. 8) in the body on the opposite side of the split 26. Upper mounting pin 62 holds the gas tube 16 (shown in FIG. 10) into the gas block via hole 66. Pin 62 engages hole 63 near the distal end of the gas tube and secures the gas tube by the pin passing through hole 66 on both sides of the gas block as well as through hole 63. Setscrew or metering rod keeper 64 provides a stop so the metering rod can't accidentally be removed by adjusting it too far but allows the rod to be removed for cleaning. Pin 62 and keeper 64 are received in mounting pin hole 66 and keeper receiving hole 68, to assist in holding the gas tube and adjustment rod in the block 22 when in use.

Figure 7:
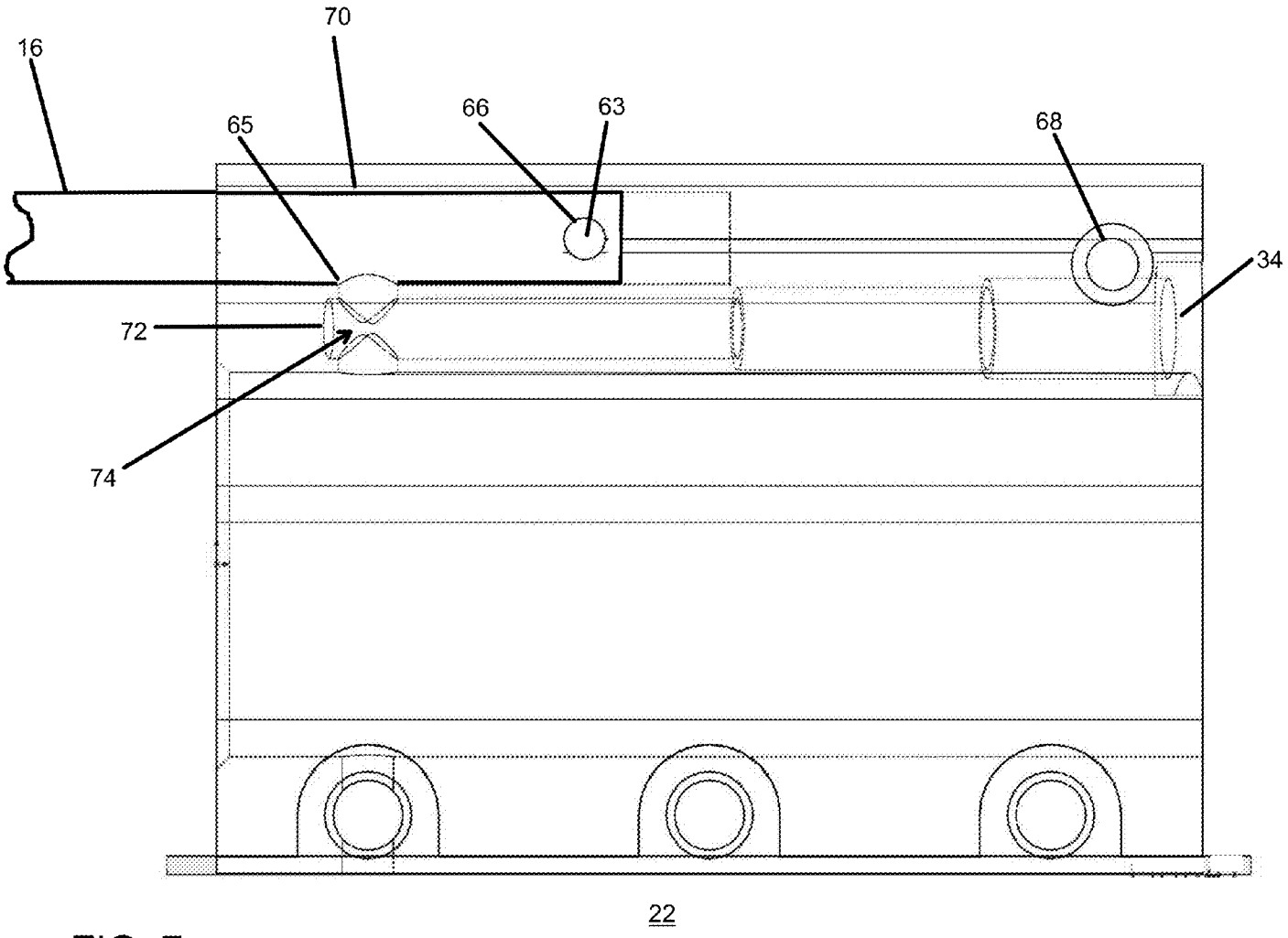
FIGS. 7, 8, 9 and 10 are additional views of the body 22, with illustration in phantom of some internal configurations thereof.
Figure 11:
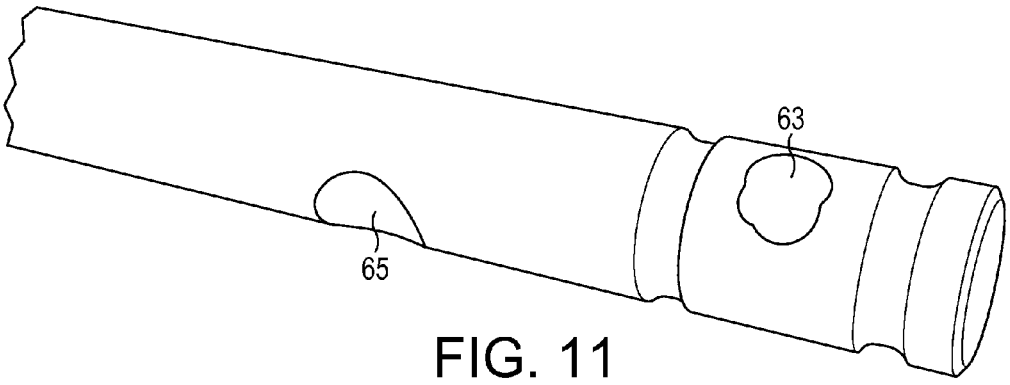
FIG. 11 is a partial perspective view of the end of the gas tube as received in the gas block.

A hole 34 is provided in the body which extends into the body to a rearward end 72 (FIG. 7). Just short of the rearward end is defined a vertically extending gas hole 74 which is adapted to mate with the gas tube hole 70, defined in the upper part of body 22 to have a rearward opening which receives the gas tube 16 therein. Adjustment rod 36 is received in hole 34 at the front end thereof and extends rearwardly therein, adjustable to move inwardly and outwardly so as to interact with and variably block the vertically extending gas transfer hole 74. The hole 34 allows the metering rod access to the rearward end 72 in the gas block. The vertically extending gas hole 74 is positioned (when the device is installed) over the gas port on the rifle barrel, through which gas from the rifle barrel is transferred to the tube hole 70, which has the gas tube 16 positioned therein such that gas opening 65 of the gas tube (FIG. 11) aligns with gas hole 74 such that gas passing through hole 74 transfers into opening 65 of the gas tube. The end 40 of adjustment rod 36 distal from knob 20 interacts with rearward end 72 and vertically extending gas hole 74 which defines a gas metering chamber, whereupon the threaded adjustment of rod 36 via threads 42 with the corresponding threads in the body 22, extends the end of the rod into and out of the region of the tube rearward end 72/gas hole/metering chamber 74 to adjustably block or unblock the transfer of gas from the barrel through the metering chamber 74 and back through the gas tube hole 70 to the firearm gas tube 16. The hole 34 is formed at an angle to the direction of the barrel, suitably 9.27 degrees off of the direction of the barrel, to angle the adjustment control away from the barrel for easier access by the user. The adjustment rod has a rearward end 36 which is substantially smooth in the illustrated embodiment, the most rearward portion 40 defining an interaction region that interacts with the gas hole 74/end 72 to control the amount of return gas. A threaded region 42 is formed approximately centrally on the adjustment rod, and the threads stop against the metering rod keeper, wherein a smooth portion 46 is positioned between the keeper (when the rod is installed) and a keyed region 48, keyed region 48 suitably being square in cross section in a particular embodiment. Adjustment knob 20 is has a through channel which receives the portion 48 of the adjustment rod therethrough, and a mounting bolt 52 holds the adjustment knob to the adjustment rod by engagement with threaded opening 50 in the end of the adjustment rod and the corresponding shape of the interior of knob 20.

A spring 54 is received within the opening of the knob, and is held in position by the engagement of bolt 52 with opening 50. The spring effects to bias the knob in the direction of arrow 56 in absence of interaction by the user.

A keyed region 58 is formed at the interior end of the knob 20, having a central interior opening of corresponding to that of keyed region 48. The external configuration of the keyed region is preferable hexagonal in the illustrated embodiment. Flat portions 59, 61 are defined on the front face of body 22 adjacent the opening of hole 34, such that when rod 36 is installed, the spring 54 biases knob 20 such that portion 58 interacts with and engages flats 59, 61. When the knob is moved by the spring in the direction of arrow 56 the flats on the keyed member 58 engage with flats 59, 61 on the gas block near the opening of hole 34, locking the knob and therefore the metering rod into the current position. The hexagonal configuration of keyed region 58 provides 6 incremental stop positions per rotation of the knob, providing a stepped adjustment of the gas transfer amount. Other configurations to keyed region and possibly adjustment of the flats 59, 61, may be employed to provide more or less than 6 steps per rotation of the adjustment knob.

To install the device on a rifle, prior to when keeper 64 is fully received in hole 68, rod 36 is inserted into hole 34 sufficiently that the threads stop against the metering rod keeper positioned inwardly of hole 68, the inserted keeper and its interaction with the outward edge 43 of the threads 42 ensures that the rod 36 and attached components will be retained within mounting body 22 by the interaction of keeper 64 and the threads, preventing the rod 36 from being removed from hole 34, while still allowing rotation of the rod by the existence of portion 46.

A corresponding threaded portion is defined in the hole 34 to receive threaded rod portion 42 therein, whereby the threaded engagement of the rod portion allows adjustable fixing of the position of the rod within the hole 34.

Referring to FIG. 7, a side view of the body 22, with illustration in phantom of internal configurations thereof, the hole 34 communicates with the firearm gas tube 16 via vertical metering chamber/gas hole 74/tube hole 70 to convey the gas from the barrel therethrough. The end of adjustment rod 36 distal from knob 20 interacts with end 72 and hole 74, whereupon the threaded adjustment of rod 36 via threads 42 with the corresponding threads in the body 22, extends the end of the rod into and out of the opening of hole 74 and end 72 to adjustably block or unblock the transfer of gas from the barrel through the chamber/hole 74/into opening 65 of gas tube 16 and back through the firearm gas tube. This adjustment allows variable modification of the amount of gas that is returned, from completely closing off any return of gas by blocking the passage of gas through chamber 74 to the gas tube opening 65 and thereby to the gas tube 16 to fully allowing passage of gas by non-blocking of the gas through chamber 74, and any variable amount in between.

In operation, the spring effects to bias the knob in the direction of arrow 56 in absence of interaction by the user such that portion 58 will be positioned in between flats 59 and 61, so that rotation of the knob 20 will not take place and accordingly rod 36 will not rotate. However, by pulling the knob 20 in the direction of arrow 76 in FIG. 4, the portion 58 will be disengaged with the flats 59, 61, by sliding of portion 20 along keyed portion 48 of rod 36 in the direction of arrow 76, whereby rotation of the knob 20 about the rotation axis 60 will cause a corresponding rotation of rod 36, which results in the threads 42 translating within the corresponding threads of the body 22, which extends the rod further into the opening 34 or retracts the rod from the opening, depending on the rotation direction and the threads, to change the position of the end of rod 36 relative to chamber 74, to change the amount of gas transfer from the barrel to the gas tube 16.

Thus, to adjust the gas block to change the amount of gas return, the user grasps the adjustment knob, pulls it outwardly (away from the body 22) which causes the portions 59, 61 and 58 to disengage from one another whereby rotation of the knob will cause the rod 36 to rotate, translating the rod into or out of the opening 34 as a result of the threads 42 and corresponding threads in the body 22. As the end of the rod blocks more or less of the opening from the barrel, more or less gas is returned to the gas tube when the firearm is fired. The adjustment can be between complete blocking so essentially no gas is returned to fully open so that a maximum amount of gas is returned to the gas tube. The user can manually adjust the degree of blocking between the extremes of fully open and fully closed without being constrained by preset or predetermined stops. Once the knob is released, the bias of the spring causes the knob to move such that portion 58 is received between the flats 59, 61, so that rotation of the knob will not occur and therefore a corresponding rotation of the rod 36 will not occur, so the gas return will not be unintentionally adjusted.

While the illustrated embodiment employs a spring biased mechanism to provide adjustment locking, other methods can be employed. For example, a detent mechanism to keep the knob from turning until the user turned the knob to the next detented location may be employed.

Accordingly, the gas block allows fine degree of adjustment of the amount of return gas provided to the gas tube. The design is operable without requiring the use of tools and provides the metering rod or setscrew at an angle from the front of the gas block making it more accessible.

While a preferred embodiment of the present gas block has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A gas block for a firearm, comprising:

a body for mounting on a barrel of the firearm, said body having a gas hole provided therein, adapted to mate with a firearm gas tube and firearm barrel gas discharge hole; and a hand-operable, in absence of use of a tool, gas block variable extensible adjustment member for manually adjusting the amount of gas transferred through the gas hole from the firearm barrel to the firearm gas tube, wherein said gas block variable extensible adjustment member comprises an extensible member that adjustably extends into and out of a portion of a gas metering chamber for adjustably controlling transfer of gas from the gas hole to the firearm gas tube, and wherein said gas block variable adjustment member has a keyed portion thereon and said body has corresponding portions for interacting with the keyed portions for providing stepwise adjustment of the amount of gas transferred.

2. The gas block according to claim 1, wherein said gas block adjustment member comprises a threaded portion in threaded engagement with a portion of the body to enable variable adjustment of the amount of extension into or out of the portion of the gas metering chamber.

3. The gas block according to claim 1, wherein said gas block variable adjustment member is positioned at an angle non-parallel and non-perpendicular to an angle of a bore of the firearm barrel.

4. The gas block according to claim 3, wherein said angle is 9.27 degrees off of the angle of the bore of the firearm barrel.

5. The gas block according to claim 1 wherein said adjustment member comprises an adjustment knob normally biased to a locked position, whereby attempted rotation of the adjustment knob when in the locked position does not result in adjustment of the amount of gas transferred through the gas tube.

6. The gas block according to claim 5 wherein moving of said adjustment knob against the bias disengages the adjustment knob from the locked position to enable rotation of the adjustment knob to effect adjustment of the amount of gas transferred through the gas tube.

7. The gas block according to claim 1, wherein the corresponding portion is substantially square in cross section.

8. The gas block according to claim 1, wherein said keyed portion has an external configuration that is hexagonal.

9. The gas block according to claim 1, wherein said keyed portion is provided on a rotary adjustment knob.

10. The gas block according to claim 1, wherein said adjustment knob provides multiple adjustment steps to the amount of gas transferred per rotation of said adjustment knob.

11. The gas block according to claim 10, wherein the number of said multiple adjustment steps to the amount of gas transferred per rotation of said adjustment knob is six.

* * * * *